US006334321B1

(12) United States Patent
Said et al.

(10) Patent No.: US 6,334,321 B1
(45) Date of Patent: Jan. 1, 2002

(54) METHOD AND SYSTEM FOR DEFROST CONTROL ON REVERSIBLE HEAT PUMPS

(75) Inventors: Wahil Said, Lyons; Joseph Ballet, Bressolles; Sylvain Serge Douzet, Saint Maurice de Beynost, all of (FR)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/525,348

(22) Filed: Mar. 15, 2000

(51) Int. Cl.[7] ..... F25D 21/06
(52) U.S. Cl. ..... 62/155; 62/156
(58) Field of Search ..... 62/155, 156, 160, 62/151, 234, 140, 128, 324.5, 277, 278

(56) References Cited

U.S. PATENT DOCUMENTS 4,328,680 A * 5/1982 Stamp, Jr. et al. ..... 62/156 X
4,573,326 A * 3/1986 Sulfstede et al. ..... 62/156

* cited by examiner

*Primary Examiner*—Harry B. Tanner
(74) *Attorney, Agent, or Firm*—Wall Marjama & Bilinski

(57) ABSTRACT

A control algorithm controls a coil defrosting cycle on a reversible heat pump by storing values representing performance of a clean coil, i.e., one with no frost build-up, and monitoring those values as they evolve over time. The values are used to create a "frost factor" whose value varies between 0%, signifying a clean coil, and 100%, signifying a heavily frosted coil. When the frost factor reaches a predetermined value close to 100%, the refrigerant cycle of the heat pump is inverted (reversed) to achieve coil defrosting.

6 Claims, 3 Drawing Sheets

METHOD AND SYSTEM FOR DEFROST CONTROL ON REVERSIBLE HEAT PUMPS

FIELD OF THE INVENTION

This invention pertains to the field of reversible heat pumps, and in particular, to controlling the coil defrosting cycle while in heating mode.

BACKGROUND OF THE INVENTION

Heat pump systems use a refrigerant to carry thermal energy between a relatively hotter side of a circulation loop to a relatively cooler side of the circulation loop. Compression of the refrigerant occurs at the hotter side of the loop, where a compressor raises the temperature of the refrigerant. Evaporation of the refrigerant occurs at the cooler side of the loop, where the refrigerant is allowed to expand, thus resulting in a temperature drop. Thermal energy is added to the refrigerant on one side of the loop and extracted from the refrigerant on the other side, due to the temperature differences between the refrigerant and the indoor and outdoor mediums, respectively, to make use of the outdoor mediums as either a thermal energy source or a thermal energy sink. In the case of an air to water heat pump, outdoor air is used as a thermal energy source while water is used as a thermal energy sink.

The process is reversible, so the heat pump can be used for either heating or cooling. Residential heating and cooling units are bidirectional, in that suitable valve and control arrangements selectively direct the refrigerant through indoor and outdoor heat exchangers so that the indoor heat exchanger is on the hot side of the refrigerant circulation loop for heating and on the cool side for cooling. A circulation fan passes indoor air over the indoor heat exchanger and through ducts leading to the indoor space. Return ducts extract air from the indoor space and bring the air back to the indoor heat exchanger. A fan likewise passes ambient air over the outdoor heat exchanger, and releases heat into the open air, or extracts available heat therefrom.

These types of heat pump systems operate only if there is an adequate temperature difference between the refrigerant and the air at the respective heat exchanger to maintain a transfer of thermal energy. For heating, the heat pump system is efficient provided the temperature difference between the air and the refrigerant is such that the available thermal energy is greater than the electrical energy needed to operate the compressor and the respective fans. For cooling, the temperature difference between the air and the refrigerant generally is sufficient, even on hot days.

Under certain operating conditions, frost builds up on a coil of the heat pump. The speed of the frost build-up is strongly dependent on the ambient temperature and the humidity ratio. Coil frosting results in lower coil efficiency while affecting the overall performance (heating capacity and coefficient of performance (COP)) of the unit. From time to time, the coil must be defrosted to improve the unit efficiency. In most cases, coil defrosting is achieved through refrigerant cycle inversion. The time at which the coil defrosting occurs impacts the overall efficiency of the unit, since the hot refrigerant in the unit, which provides the desired heat, is actually cooled during coil defrosting.

Conventional units typically use a fixed period between defrosting cycles, irrespective of how much frosting actually occurs within the fixed period. In order to optimize the unit performance while in the heating mode, it is necessary to optimize the time at which coil defrosting occurs.

SUMMARY OF THE INVENTION

Briefly stated, a control algorithm controls a coil defrosting cycle on a reversible heat pump by storing values representing performance of a clean coil, i.e., one with no frost buildup, and monitoring those values as they evolve over time. The values are used to create a "frost factor" whose value varies between 0%, signifying a clean coil, and 100%, signifying a heavily frosted coil. When the frost factor reaches a predetermined value close to 100%, the refrigerant cycle of the heat pump is inverted (reversed) to achieve coil defrosting.

According to an embodiment of the invention, a method for controlling a coil defrosting cycle in a reversible heat pump system using a refrigerant cycle includes monitoring a plurality of performance variables of the heat pump system; determining a final frost factor from the plurality of performance variables; and defrosting the coil after the frost factor reaches a predetermined value and certain conditions of the system are met.

According to an embodiment of the invention, a system for controlling a coil defrosting cycle in a reversible heat pump system using a refrigerant cycle includes means for monitoring a plurality of performance variables of the heat pump system; means for determining a final frost factor from the plurality of performance variables; and means for defrosting the coil after the frost factor reaches a predetermined value and certain conditions of the system are met.

BRIEF DESCRIPTION OF THE DRAWING

FIGS. 2A and 2B are aligned.

DETAILED DESCRIPTION OF THE INVENTION

Figure 1:
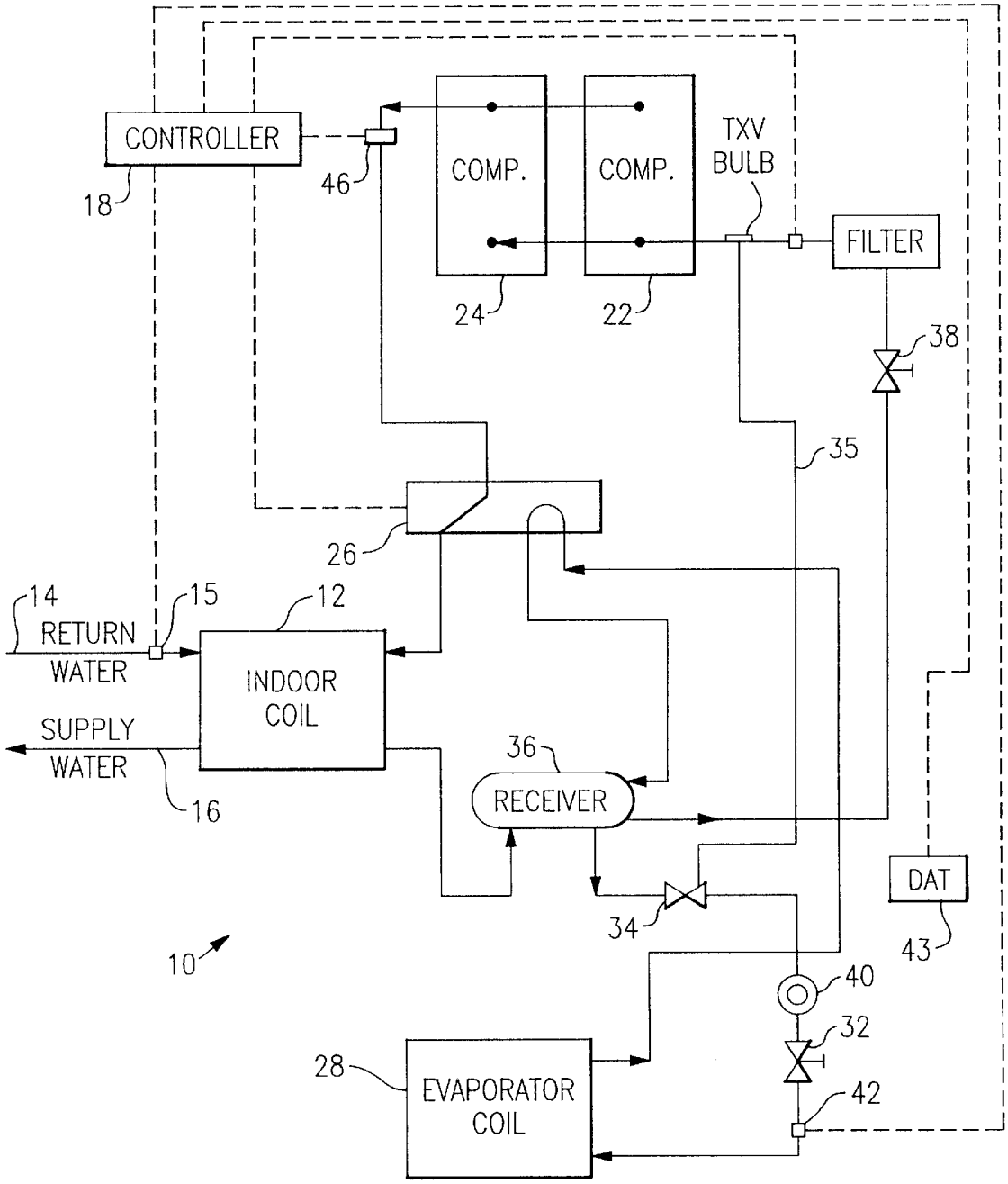
FIG. 1 shows a schematic diagram of a reversible heat pump system.

Referring now to FIG. 1, a heat pump 10 includes an indoor coil 12 operatively connected with a return water line 14 and a supply water line 16. Indoor coil 12 has refrigerant circulated therethrough for the purpose of cooling or heating the water passing over indoor coil 12 as it is circulated through the system. Indoor coil 12 acts as an evaporator in the cooling mode to remove heat from the return water and as a condenser in the heating mode to provide heat to the supply water. During the defrost mode, the system switches from the heating mode to the cooling mode to allow the heat from the return water to be transferred by the refrigerant to the outdoor coil to facilitate the defrosting thereof.

Indoor coil 12 is connected to a standard closed loop refrigeration circuit which includes compressors 22, 24, a reversing valve 26, an evaporator coil 28, isolation safety valves 32, 38, and a sight glass 40. A receiver 36 stores the refrigerant fluid in the system. Reversing valve 26 is selectively operated by a controller 18 to function in the respective cooling, heating, or defrost modes. A thermal expansion valve (TXV) 34 is shown between receiver 36 and evaporator coil 28. TXV 34 is controlled by a TXV bulb connected by a capillary tube 35.

Coil frosting is monitored through three measurements: saturated suction pressure (SSP), outdoor air temperature (OAT), and the refrigerant liquid temperature (RLT) of the refrigerant as it enters evaporator coil 28. A transducer 46 in the system between compressors 22, 24 and reversing valve 26 records the SDP, also known as the circuit head pressure. A transducer 44 between reversing valve 26 and compressors 22, 24 records the SSP which is converted to the saturated suction temperature (SST). Pressure transducers are preferably used instead of thermistors because of their greater accuracy. The outside air temperature (OAT) is read by a sensor 43 such as a digital thermometer. The refrigerant liquid temperature (RLT) is read by a defrost sensor 42. The RLT is affected by frost on the line and thus is used to determine an indication of frost. In addition, the inlet water temperature in return water line 14 is measured by a sensor 15.

Transducers 44, 46 and sensors 15, 42, 43 are connected to controller 18. Controller 18 stores and executes a control algorithm that stores values representing performance of a clean coil Oust after defrosting) and monitors them as they evolve over time. Those values are translated into a "frost factor" whose value can vary between 0% (clean coil) and 100%. When the frost factor gets close to 100%, the refrigerant cycle is inverted to achieve coil defrosting. This is a significant improvement over most of the algorithms currently used which are based on a fixed time between two defrost cycles. System 10 thus performs a circuit defrost session when the amount of frost covering evaporator coil 28 affects the system performance.

According to the present invention, the frost factor is estimated by determining a circuit reference delta (OAT minus SST) when the unit is stabilized after a defrost session. The evolution of the current delta versus the reference delta is permanently computed and integrated to provide a frost factor estimation (frost_i).

A frost factor of 100% is considered to be an indicator of a fully frozen exchanger. A circuit defrost session runs if the frost factor is 100%, if a specified delay period, preferably 15 minutes, has elapsed between two circuit defrosts, and if the inlet water is more than a specified temperature, preferably 54° F. If the delay period has not elapsed, the defrost is delayed.

When the circuit goes into defrost mode, all fan stages are preferably stopped and the reversing valve is reversed to force the circuit into cooling mode. If during a defrost session the circuit head pressure (SDP) reaches a specified pressure threshold (based on the high pressure trip point), the circuit fan is preferably restarted momentarily to avoid a circuit shut down due to high pressure trip. This fan is stopped when the circuit head pressure drops below the threshold minus 30 psi.

A circuit defrost session preferably becomes active when the final frost factor reaches 100% provided that the 15 minutes delay between circuit defrost sequences has elapsed and provided that the inlet water is greater than a specified temperature that depends on the compressor used. The specified temperature is generally in the range between 50° F. to 65° F., such as 54° F. The time between defrost sequences is preferably at least 15 minutes.

Defrosting is achieved when the circuit defrost temperature as determined by sensor 42 is above the end of the defrost setpoint which is 77° F. in this example. Defrost is stopped regardless of other conditions if the inlet water temperature in return line 14 drops below a specified temperature such as 50° F. which depends on the type of compressor used. Ten minutes is set as the preferable maximum duration for a defrosting cycle. If the 10 minutes defrost maximum duration has elapsed, the defrost session is stopped no matter what other conditions prevail. If during a defrost session the unit is manually commanded to stop, the defrost session continues until completed.

Figures 2, 2A:
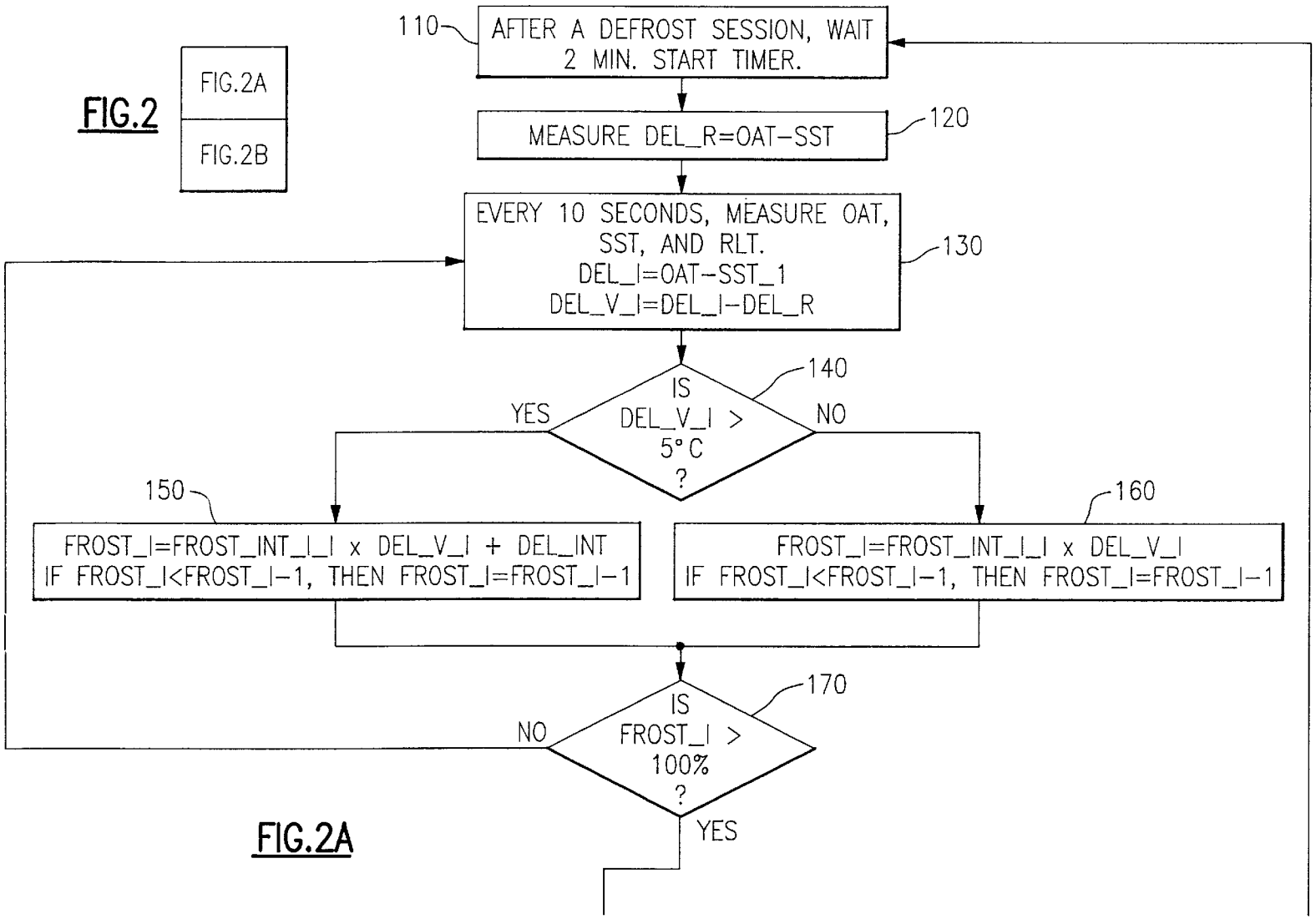
FIGS. 2A and 2B show a flow chart of the method of the present invention.
FIG. 2 is a diagram showing how
Figure 2B:
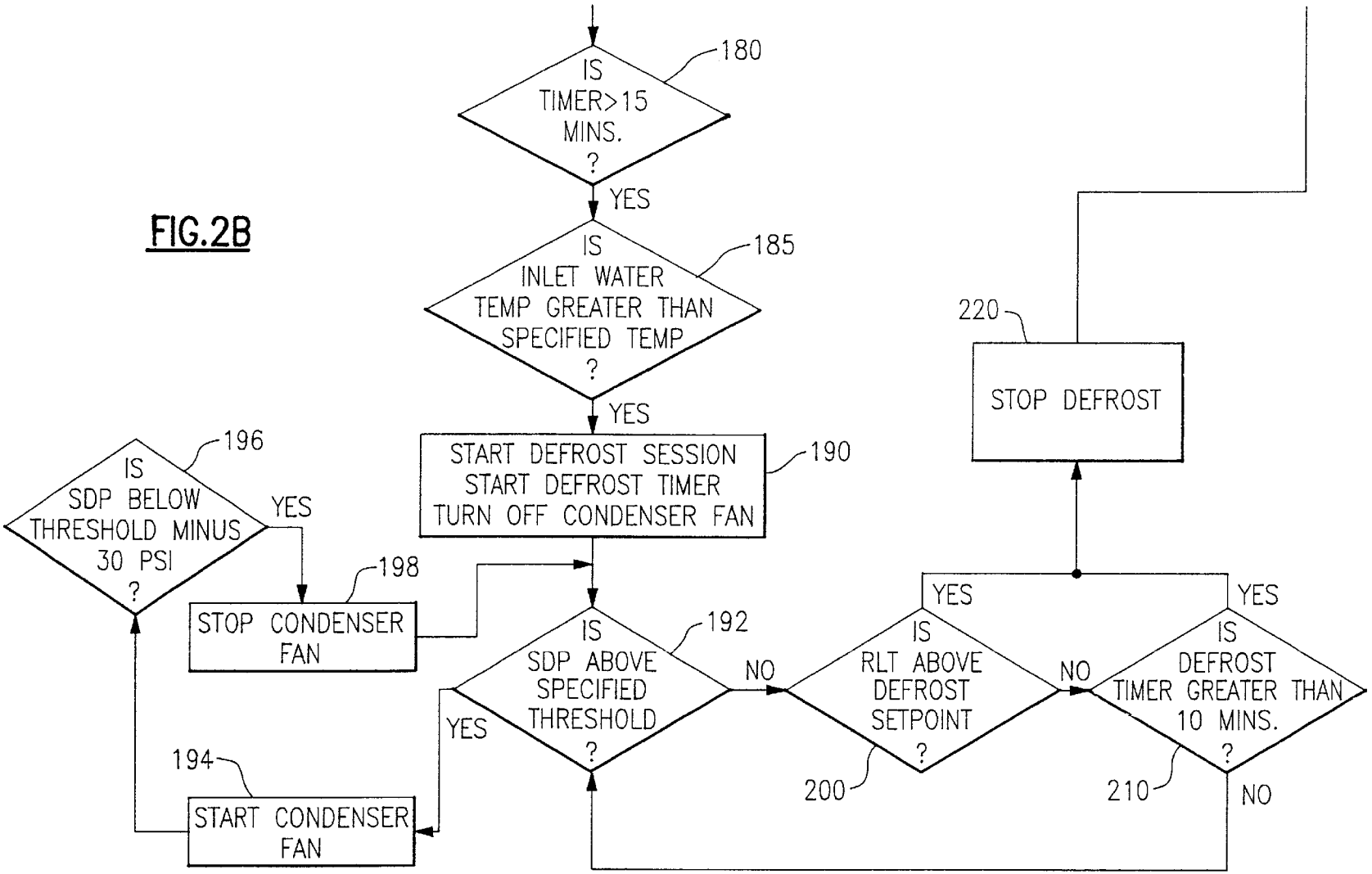

Referring to FIGS. 2A and 2B, a timer is started in step 110 preferably after two minutes has elapsed since the last defrost cycle. In step 120, a reference value del_r is determined as the OAT minus the SST. In step 130, the values for the OAT, SST, and RLT are measured periodically, preferably every 10 seconds. The temperature delta del_i is computed as the OAT minus SST_i, where SST_i is the SST at time i. Then, the delta change is calculated according to del_v_i=del_i−del_r. In step 140, del_v_i is checked to see if the delta change exceeds 5° C. (9° F.), and if so, an integrator factor del_int is applied in step 150. The value for del_int is determined through laboratory testing and depends on the geometry of the coil, the air velocity through the coil, etc. For Carrier models 30RH17 through 30RH240, the value for de_int is 0.5.

In step 150, frost_i, the frost factor at time i, is set to frost_int_i_i times del_v_i added to the integral factor del_int. Frost_i_is the value for frost_int_i at time i, where frost_i is a multiplier or gain factor in %/° C. whose value is usually always 0.7. In some cases, the value differs from 0.7, and frost_int_i is determined through routine experimentation according to the size of the coil, the size and type of compressor, and the amount of air flow across the coil. Frost_i is then compared to the previously determined frost factor, that is, at time i-1, where i-1 refers to the time one measurement period previous to time i, which in this case is preferably 10 seconds previous to time i. The greater of frost_i and frost_i 1 becomes the value for frost_i.

In step 160, if the delta change does not exceed 5° C. (9° F.), the integrator factor del_int is not applied and frost_i is set equal to frost_int_i_i times del_v_i. Frost_i is compared to frost_i-1 and set to the greater value The frost factor is checked in step 170 to see if it exceeds 100%, and if not, the cycle begins again at step 130. If the frost factor is greater than 100%, the timer is checked in step 180 to see if more than 17 minutes (the 15 minutes from step 180 plus the 2 minutes from step 110) have elapsed since the last defrost cycle. If not, the system waits until the timer exceeds 15 minutes before passing control to the next step. In step 185, the inlet water temperature is checked to ensure it is greater than a specified temperature before starting the defrost session in step 190. The defrost timer is started and all condenser fans are turned off. In step 192, if the SDP is above a specified threshold that is based on the high pressure trip point, the fan is restarted momentarily in step 194 to bring the pressure down to a value preferably 30 psi below the threshold as checked in step 196, at which time the fan is stopped in strep 198.

The RLT is checked in step 200 to see if it exceeds a designated value, preferably 25° C. (45° F.) for the line of Carrier equipment characterized by Carrier models 30RH17 through 30RH240, and if so, the defrost session stops in step 220. If RLT is not equal to 25° C. (45° F.) in step 200, the defrost timer is checked to see if the defrost session has run more than 10 minutes, and if so, the defrost session stops in step 220. Program control returns to step 110 and the cycle begins anew.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

We claim:

1. A method for controlling a coil defrosting cycle in a reversible heat pump system using a refrigerant cycle, comprising the steps of:

monitoring a plurality of performance variables of said heat pump system;

determining a final frost factor from said plurality of performance variables; and defrosting said coil after said frost factor reaches a predetermined value and certain conditions of said system are met;

wherein said step of monitoring includes beginning a first timer; periodically monitoring an outside temperature (OAT) near said coil; and periodically monitoring a saturated suction temperature (SST) of said heat pump system; and wherein said step of determining include determining a first temperature delta as a reference; determining a second temperature delta as the OAT minus the SST;

determining a change in said second temperature delta by comparing said second temperature to said first temperature delta;

determining a first frost factor as said change times a gain factor if said change is not greater than a specified amount, and determining said first frost factor as said change times said gain factor plus an integrator factor if said change is greater than said specified amount;

for each subsequent period, determining a second frost factor as said change times said gain factor if said change is not greater than said specified amount, and determining said second frost factor as said change times said gain factor plus said integrator factor if said change is greater than said specified amount; and selecting said final frost factor as a greater of said first frost factor and said second frost factor.

2. A method according to claim 1, wherein said step of defrosting includes:

inverting said refrigerant cycle in said heat pump system when said first timer exceeds a specified period of time and said inlet water temperature is greater than a specified temperature;

turning off a condenser fan; and starting a second timer.

3. A method according to claim 2, wherein said step of monitoring includes periodically monitoring a saturated discharge pressure (SDP) of said system.

4. A method according to claim 3, wherein said step of defrosting further includes:

starting said condenser fan if said SDP exceeds a specified threshold; and stopping said condenser fan when said SDP drops below said specified threshold by a specified amount.

5. A method according to claim 4, wherein said step of monitoring includes monitoring a refrigerant liquid temperature of refrigerant liquid entering said coil.

6. A method according to claim 5, wherein said step of defrosting further includes stopping said step of inverting said refrigerant cycle when said RLT exceeds a defrost setpoint or said second timer exceeds a specified period of time.

* * * * *

UNITED STATES PATENT AND TRADEMARK OFFICE

CERTIFICATE OF CORRECTION

PATENT NO. : 6,334,321 B1
DATED : January 1, 2002
INVENTOR(S) : Said et al.

It is certified that error appears in the above-identified patent and that said Letters Patent is hereby corrected as shown below:

Title page,
Delete Item [75] and replace with following:
[75] Inventors Wahl Said, Lyon; Joseph Ballet, Bressolles; Sylvain Serge Douzet, Saint Maurice de Beynost, all of (FR)

Signed and Sealed this

Fourth Day of June, 2002

*Attest:*

*Attesting Officer*

JAMES E. ROGAN
*Director of the United States Patent and Trademark Office*